US005184116A

United States Patent [19]

Daugherty et al.

[11] Patent Number: 5,184,116

[45] Date of Patent: Feb. 2, 1993

[54] BACK-LIGHTABLE DIFFUSIVE DISPLAY SIGN

[75] Inventors: Ronald R. Daugherty, Washington; Richard J. Petrocy, Carteret, both of N.J.

[73] Assignee: Mediatronics, Inc., Carteret, N.J.

[21] Appl. No.: 590,914

[22] Filed: Oct. 1, 1990

[51] Int. Cl.[5] ..... G09G 3/16

[52] U.S. Cl. ..... 340/764; 340/763; 340/783; 340/815.24; 340/815.27; 40/447; 359/48; 362/355

[58] Field of Search ..... 340/763, 764, 783, 815.02, 340/815.05, 815.08, 815.24, 815.27; 40/447, 448, 449; 362/355; 350/345; 359/48

[56] References Cited

U.S. PATENT DOCUMENTS

| | | | |
|---|---|---|---|
| 3,581,301 | 5/1971 | Stutz et al. | 340/764 |
| 4,163,332 | 8/1979 | Salam | 40/449 |
| 4,310,832 | 1/1982 | Fitzgerald | 340/815.24 |
| 4,468,660 | 8/1984 | Ishida et al. | 340/764 |
| 4,496,945 | 1/1985 | Stadjuhar et al. | 340/764 |
| 4,541,189 | 9/1985 | Salam | 40/447 |
| 4,729,067 | 3/1988 | Ohe | 40/448 |
| 4,761,905 | 8/1988 | Black | 340/764 |
| 4,779,082 | 10/1988 | Salam | 340/764 |

*Primary Examiner*—Ulysses Weldon
*Assistant Examiner*—Regina Liang
*Attorney, Agent, or Firm*—Mathews, Woodbridge & Collins

[57] ABSTRACT

This relates to a back-lightable display panel for displaying alphanumeric characters and graphics comprising a plurality of mechanically movable elements, each having a dark translucent face and a bright translucent face which are moved from one to the other face interchangeably by a series of electromechanical driving elements; and diffusion means interposed between the source of light and the display panel for scattering the light falling on the display panel from the source, whereby shadows cast by the electromechanical driving elements on the display panel are substantially invisible from the front of the display. The sign comprises a series of rectangular blocks which may be mounted to form a mosaic of any desired size.

16 Claims, 15 Drawing Sheets

FIG. 7

[X] = RELAY POWER ON  [ ] = RELAY POWER OFF

| TIME CYCLE | ROW SOLENOID | | | | | COMBINATION SOLENOID | | | | |
|---|---|---|---|---|---|---|---|---|---|---|
| | G | H | I | J | K | V | W | X | Y | Z |
| 1 | | | | | | X | | | | X |
| 2 | X | | | | | X | | | | X |
| 3 | | | | | | | | | | |
| 4 | | | | | | | X | | X | |
| 5 | | X | | | | | X | | X | |
| 6 | | | | | | | | | | |
| 7 | | | | | | | | X | | |
| 8 | | | X | | | | | X | | |
| 9 | | | | | | | | | | |
| 10 | | | | | | | X | | X | |
| 11 | | | | X | | | X | | X | |
| 12 | | | | | | | | | | |
| 13 | | | | | | X | | | | X |
| 14 | | | | | X | X | | | | X |
| | | | | | | | | | | |
| | | | | | | | | | | |
| | | | | | | | | | | |

BACK-LIGHTABLE DIFFUSIVE DISPLAY SIGN

This invention relates in general to back-lighted signs having transparent or translucent viewing surfaces, more particularly, signs comprising composites of individually manipulated elements behind the viewing surface.

BACKGROUND OF THE INVENTION

In the case of large, back-lighted signs which are displayed on the streets or in malls or in other public places, and which are designed to convey periodically changing messages, the viewing surface of the sign customarily comprises a plurality of elements of different colors which are periodically manipulated to assume a series of preselected positions forming different images. This requires a central system of electrical and/or mechanical devices interposed between the light source and the viewing surface for moving the elements according to a prearranged program. One of the problems in prior art signs of this type is that the elements of the control system cast shadows which are visible on the front surface of the sign, interfering with the message which they are attempting to deliver.

Accordingly, it is the primary object of the present invention to improve the appearance and clarity of back-lighted signs comprising a plurality of movable components, by substantially eliminating or drastically reducing the shadows cast on the working face of the sign by the driving elements of the movable sign components.

This and other objects are achieved in a sign system according to the present invention in which the displayed characters and graphics visible from the transparent or translucent front viewing surface are back-lighted from a multipoint or diffused light source. This technique tends to reduce or eliminate shadows cast by the electrical or mechanical elements which are interposed behind the viewing surface to manipulate the sign components. This may be achieved by interposing a plate of diffusing material to divide the area between the light source and the front surface of the sign into two chambers.

The diffusion panel may be constructed either by dispersion of diffusion pigment and/or particles within a transparent panel, or by utilization of a transparent panel with a surface treatment which causes random refractive dispersion of the departing light. The objective of the diffusion panel is to evenly distribute light throughout the entire viewing surface of the device without substantial diminuation of its intensity.

The rear chamber, farthest from the viewing surface, contains all of the light sources, and all the opaque electronic and electromechanical or other driving elements which operate the multifaceted sign elements. The forward chamber between the diffusion plate and the viewing surface contains all the multifaceted elements which form the displayed character or graphics. Light emanating from the light source is thus diffused through the diffusion panel so that the components in the forward chamber, with the exception of the multifaceted sign elements, are thus obscured from the front surface of the sign, thereby preventing contamination of the display.

This is accomplished by making all of the components from transparent materials, or where transparency is impossible, maintaining a ratio between the width of background feature and its distance from the viewing surface which will allow the light which passes from the light source throughout the diffusing panel to completely obscure the background feature. A preferred ratio has been found to be a minimum of two times the projected width of the background feature. The light rays are diffused when passing through the diffusion panel which scatters the light so that an opaque object, such as an electronic component or structural member, cannot be seen from the viewing surface.

In one embodiment, the multifaceted sign elements comprise a plurality of display elements which are rotatably assembled in individual control yokes in a geometric array with solenoids operating mechanical driving means, so that the display elements are oriented by a keyboard or computer system to assume a series of preselected patterns.

The front panel in this embodiment is made from a transparent material which will allow unrestricted viewing of the changeable display elements, yet protect the components within the device from harmful atmospheric elements. The front panel has an opaque white grid network which fits precisely between the display elements. This grid will appear white to the viewer during daylight due to the reflected sunlight, and black at night due to blocking of the display's rear light source, allowing enhanced color continuity between display elements of the same color. Each display element is made of a translucent material which is the primary display color, and consists of two viewing surfaces, one of which is the primary display color, and the other of which is a contrasting color, which are fastened together in a triangular configuration by means of a yoke providing a pivot point journalled on the yoke control axle, and a cam surface which interfaces with a selection key which operates to determine which surface is to be displayed. The two display surfaces of the display element are disposed at an acute angle to each other which allows the display element to rotate freely about its axis requiring only a minimum retraction from the viewing surface, which is insufficient to create an objectionable shadow of the contrasting color on the primary display color. The displayed surfaces of the display element are pressed firmly against the inside face of the transparent viewing surface during the viewing cycle, allowing maximum clarity and resolution of the displayed message and graphics. The display elements are mounted on their respective control yokes in rows which can be configured in any orientation within the supporting board, i.e., vertically, horizontally, or diagonally.

A series of selection keys which take the form of combs are mounted in transverse relation to the rows of display elements in such a way as to allow the teeth of the comb selection key to interface with the cam surface of the respective display elements causing the element to rotate about its axis, thereby causing the proper display surface to be exposed to the viewing surface. Each of the selection keys is electromechanically moved from a first to a second position against a spring bias to select a desired viewing surface of a respective display element. A programmed chip within a computer control device or a manually operated keyboard encodes data to determine in which position the selection key should be to position individual display elements to form desired overall device displays.

After the selection keys have been positioned for all positions along a row of display elements, that row is electromechanically moved in such a manner as to interface all display element cam surfaces with their corresponding selection keys, thereby turning all display elements to display the appropriately colored surface.

The device of this embodiment may be of modular construction, with series of modules interfaces with one another under computer control or keyboard control to form an integrated display, thereby minimizing size constraints on the overall display. Modules may be interfaced either by hard wiring, or with a series of electrical connectors.

A sign in accordance with the present invention may be formed, in one embodiment, of a mosaic of a plurality of identical square sign blocks fitted together against a framework formed of a row of lamp housings stacked together with projecting flanges which engage and support the blocks in contiguous relationship.

Electronic switching circuits may be located within each modular section of the sign, at a central location within the aggregate of modules, or at a convenient distant locations. Impulses from a centralized control circuit or computer will encode the switching circuits to activate the electromechanical features of the sign modules under a timing sequence which causes the module to display a desired message, or portion of a message, or graphic representation.

Input to the device, in the form of changes in graphics are accomplished either by direct entry through a computer keyboard or are encoded from copy into the control circuit or computer through an external encoding scanning device which may be of any of the types commercially available. Communication between the input computer or control circuit and the sign is accomplished either by hard wiring, telephone modem, or radio transmission.

Another embodiment of the invention, which may be appropriate for use, for example, for displaying the prices per gallon at gas stations, includes a rectangular box having a rear compartment which houses the light source, and a forward compartment which has a front viewing face of flat translucent plastic. As in the earlier embodiment, the front and rear compartments are separated by a light diffusing panel. Two parts make up the front face of the sign, which has a background of translucent plastic, on one part of which are certain permanently inscribed legends, which are depicted in the usual manner by painting them on or molding them into the viewing surface, and on another part of which are displayed the letters, figures or other graphics, which are changed from time to time. In the example under description, the latter comprises a numerical display which is changed from time-to-time to reflect variations in gas prices.

For convenience in forming the numerical display, a selected portion of the translucent front face of the sign may be inscribed with a series of transparent figure "eights", each of which is formed of hexagonal segments to accommodate what is known in the trade as the "seven segment display", whereby different digits from 0–9 may be displayed by blocking out selected segments of the transparent figure eight. This is achieved by mounting a flat, hexagonal blocking plate to rotate from blocking to open position adjacent each of the segments of a transparent figure eight, thereby forming any desired numerical display, such as price per gallon of gas.

The rotatable blocking plates, together with solenoid-driven gears, are installed against a flat white plastic backing plate, which is interposed into the forward compartment of the sign box just behind the front viewing face, so that the position of the blocking elements is coordinated to block and unblock each of the transparent openings of the segmented transparent figure eights of the display.

The solenoid driven gears for the blocking plates may be electrically or electronically controlled from a conventional cash register or a computerized circuit connected by a radio transmitter to a remote phone receiver, which is connected through its jack to a computer for programming the sign.

The light-diffusing panel interposed vertically between the rear light source in the sign box and the compartment containing the electromechanical driving elements functions to diffuse the light from the source, so that the shadows which they cast are obscured from the front viewing plate. Thus, the clarity of the sign message, as viewed in this case by the purchase, is preserved, which is important in financial transactions.

These and other objects, features, and advantages will be apparent to those skilled in the art, upon a view of the specification hereinafter with reference to the drawings.

SHORT DESCRIPTION OF THE DRAWINGS

FIG. 7 shows a logic chart for indicating timing sequences for operation of a back-lighted sign in accordance with FIG. 1.

DETAILED DESCRIPTION OF THE INVENTION

Figure 1:
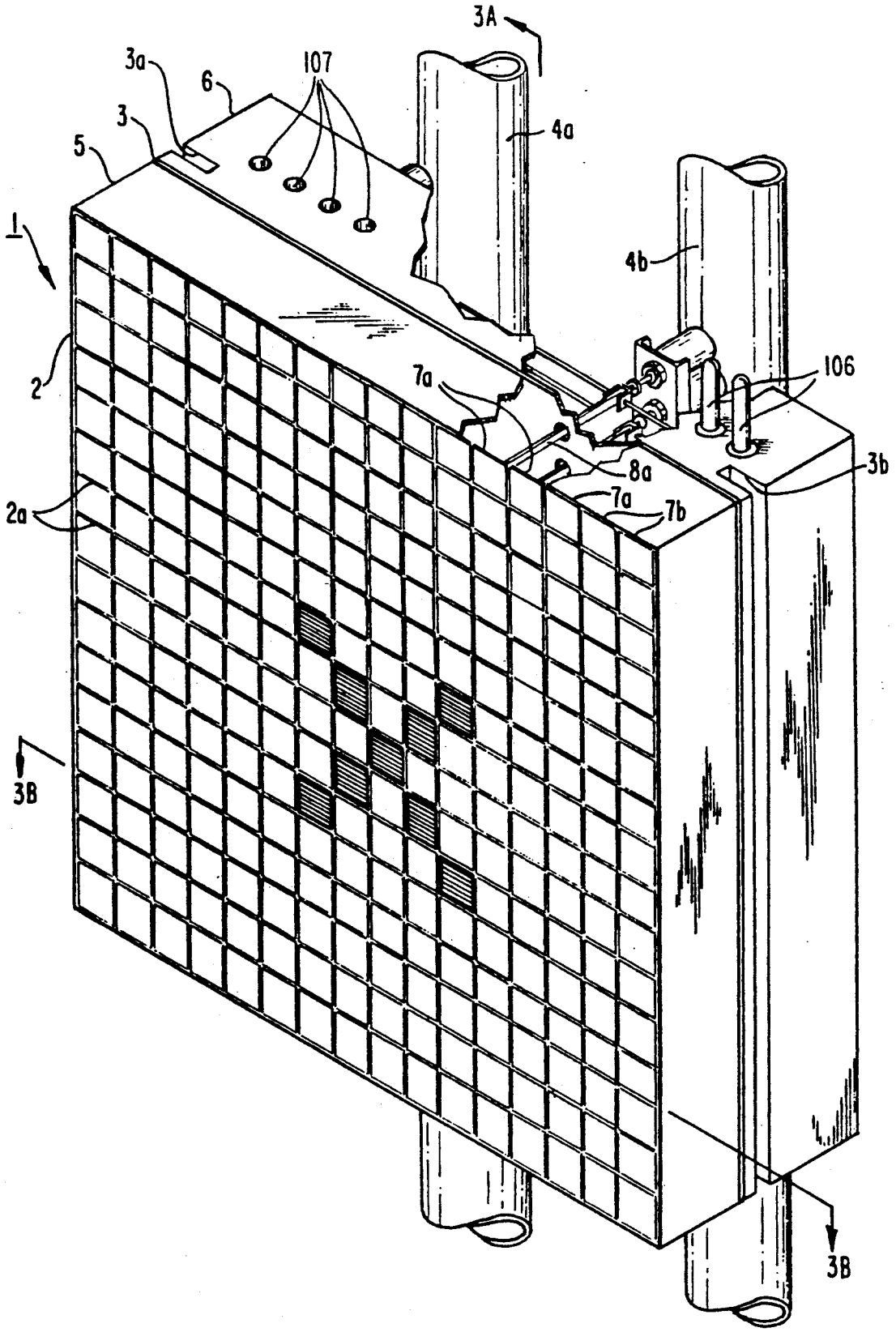
FIG. 1 shows in perspective, one embodiment of the back-lighted sign box of the present invention suitable for use in overhead signs in malls and other public places.
Figure 2A:
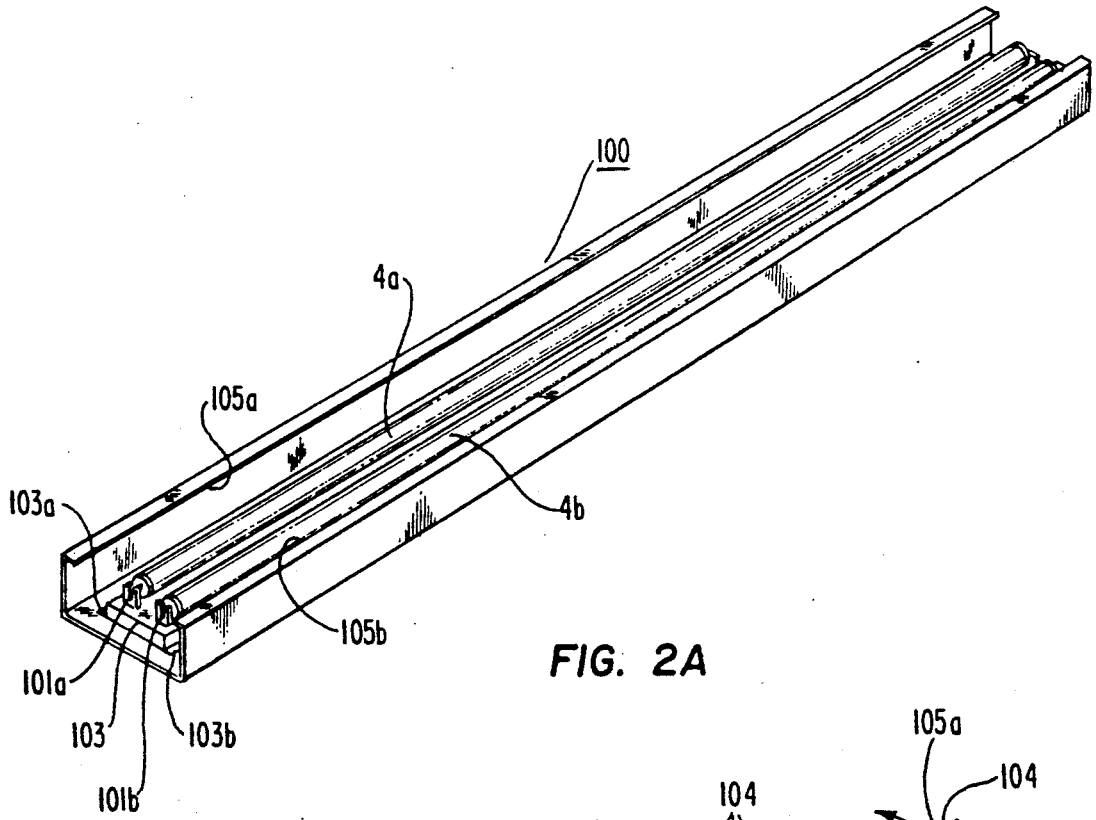
FIG. 2A shows the structure of an individual aluminum lamp housing 100 for the lamps 4*a*, 4*b* of FIG. 1.
Figure 2B:
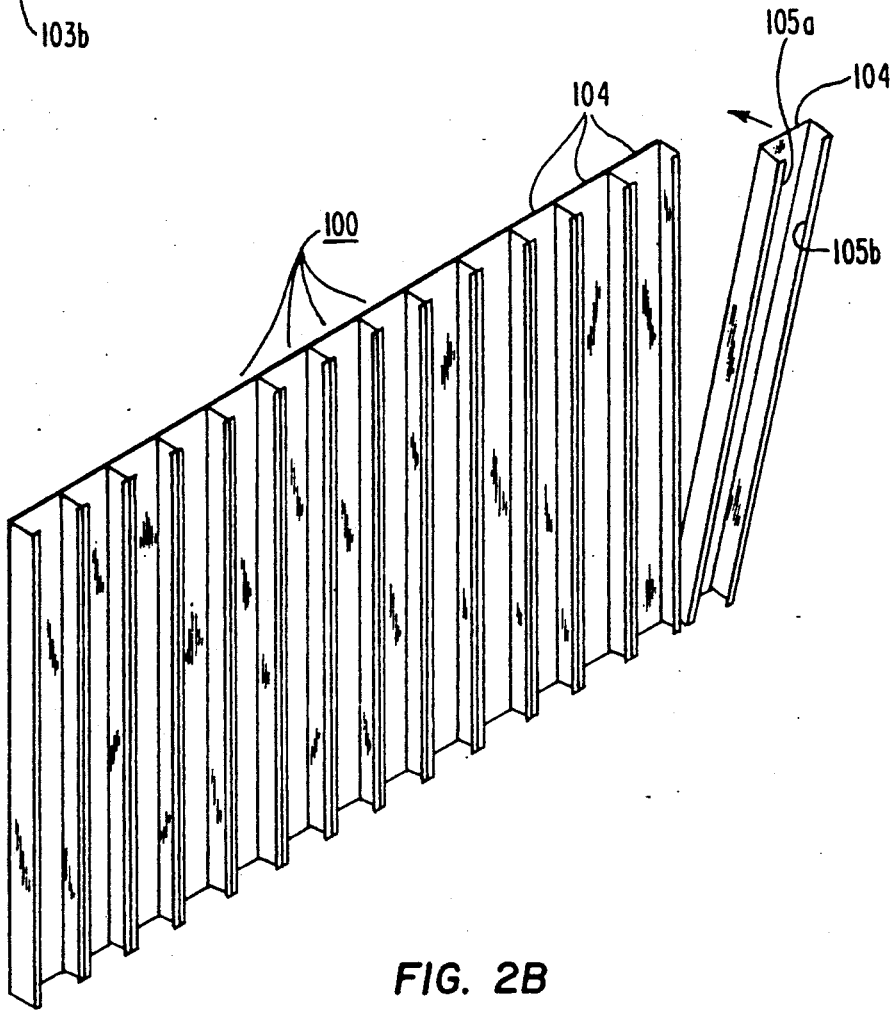
FIG. 2B shows the lamp housing 100 of FIG. 2A assembled to form a supporting frame for a typical sign mosaic. The lamps have been omitted to clarify the showing.
Figure 2C:
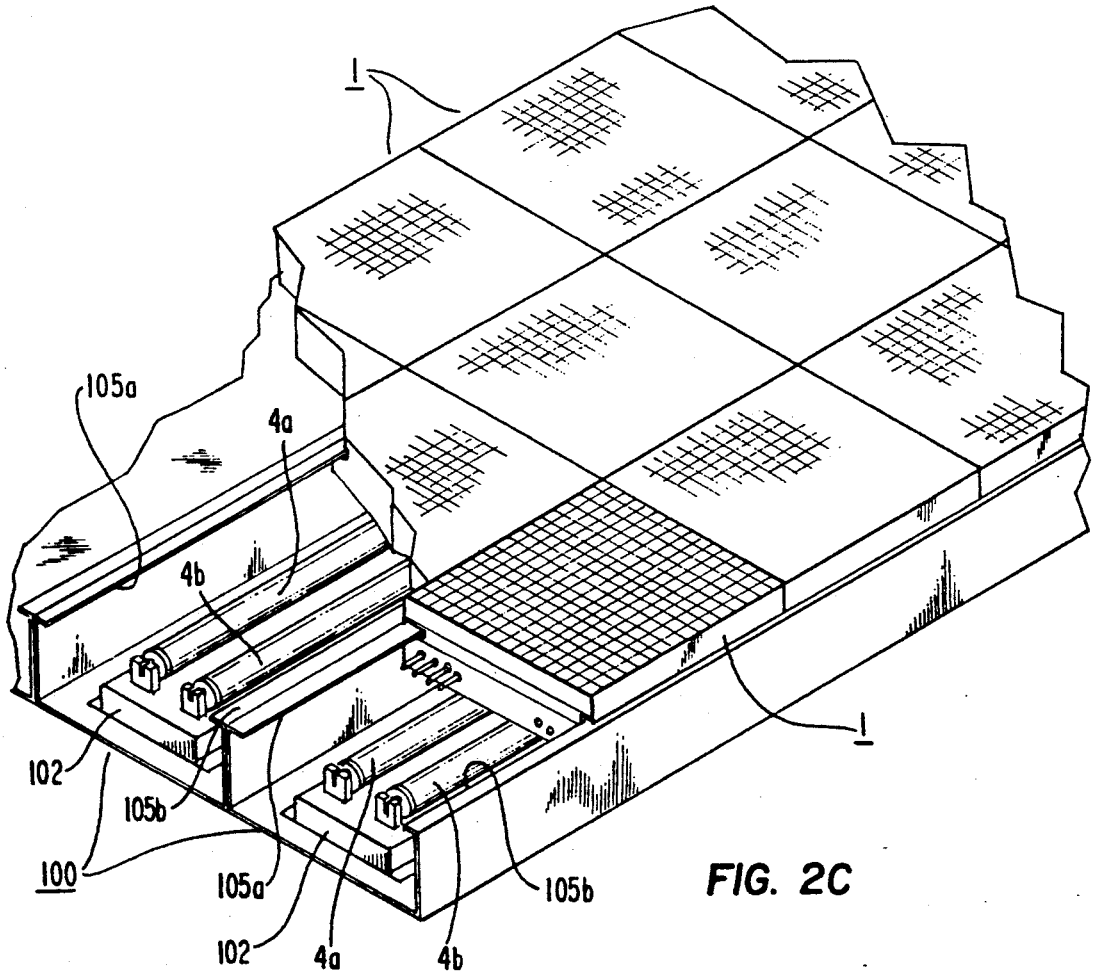
FIG. 2C shows a plurality of sign blocks of the type indicated in FIG. 1 in the process of being assembled on the supporting frame of FIG. 2B.

Referring to FIG. 1, there is shown in one embodiment a single block or tile of a back-lightable diffusive display sign in accordance with the present invention which may comprise a mosaic of such blocks assembled as shown in FIG. 2C, which is of a type which is suitable for use in a shopping mall or other public place. The single block 1 comprises a front display panel 2 which is a rectangular plate, say, ½ inch thick, of rigid transparent material, such as, for example, acrylic plastic, (transparent) upon the inner surface of which has been imposed an opaque white grid comprising lines one or two mils thick, which in the present embodiment form 256 square, say, ¾ inch on a side.

In the single block 1 of the present embodiment a front plate 2 is fitted onto a rectangular front compartment 5 which is, say 12 inches long, 12 inches wide and 6 inches deep, wide, which is closed at the sides by opaque panels, and at the rear by a diffusing panel 3. The dimensions given are for illustration only, and will vary as needed for each application.

The function of the diffusion panel 3 is to diffuse light emanating from the light sources 4*a*, 4*b* so that any opaque object between the panel 3 and the viewing surface of display panel 2 does not manifest itself as a shadow on the surface of display panel 2. The diffusion panel 3, which in the present embodiment is, say, ⅛ inch thick, is say, 12 inches by 12 inches, and is sealed against the rear of compartment 5 by Epoxy or any other well-known sealant, or an integral molded part compartment.

The diffusion panel 3 may be constructed of any well-known diffusion medium which is adapted to transmit more than fifty percent of the incident light, and causes random refractive dispersion of the light transmitted therethrough. The objective of the diffusion panel 3 is to evenly distribute light throughout the entire viewing surface of the device without substantial diminution (more than 50%) of its intensity. Numerous different types of materials may be suitable to function as diffusion panels for the purposes of the present invention. These include etched or frosted glass, matte glass, one side of which is sandblasted, configured or embossed glass having a hammered design, glass having a pyramid design, cloudy or opal glass having interspersed particles of optical fibers of various type, size and density, glass blocks made by sealing together two half-blocks, or louvered glass. Also various types of low-gloss plastics, such as, for example, acrylic, vinyl or fiberglass reinforced plastics, or glasses or plastics having the surfaces treated with paints or varnish.

For the purposes of the present invention, the diffusion layer may also comprise a liquid or solid layer in which is suspended a large number of comminuted particles.

For the purposes of the present embodiment an acrylic plastic sheet is used, known by the trademark LEXAN, is used for the diffusion panel 3.

Behind the forward compartment 5, and separated therefrom by the diffusion plate 3 is the rear compartment 6, the lateral and top and bottom walls of which are formed of opaque panels of plastic or other rigid material. Behind the open rear end of the rear compartment 6 are the line light sources, which in the present embodiment are a pair of conventional longitudinal fluorescent lights 4*a*, 4*b*, each of which is, say ½ inch in diameter and having a power rating of, say, 40 watts. Light sources 4*a*, 4*b* are parallel, and spaced apart with their center, say, 6 inches on each side of a plane through the vertical axis of the compartment 6, being aligned on a plane which is parallel to and, say, 10 inches to the rear of the diffusion plate 3. The line sources 4*a*, 4*b* each extend vertically a length that exceeds the vertical extent of the sign box 2. In preferred form, they must be mounted in a lamp housing 100 of the type shown in FIG. 2A, to be described in detail hereinafter.

Alternative to the longitudinal fluorescent lamps 4*a*, 4*b*, other source arrangements may be used, such as, for example, a large number of point sources in a plane to the rear of the compartment 6 in which case the diffusion plate 3 could be eliminated.

The top of the compartments 5 and 6 are broken away in FIG. 1 to show a small portion of the interior, revealing the electromechanical means including the solenoids 9 and levers 8 which functions to rotatably manipulate the sign display elements 7 to pivot into and out of place to form the display characters and/or graphics which appear against the interior surface of the front display panel 2, a will be explained hereinafter.

A salient feature of the invention is that the light source(s) and all of the opaque electromechanical components, such as the solenoids 9 and the opaque portions of the driving levers 8, and the other operating elements to be described hereinafter, are all located in compartments at distances from the display panel 2 which at least exceed twice the maximum dimension of the respective opaque element. The remaining portions of the electromechanical driving elements are formed of transparent material. Thus, the front display panel 2, which is made from transparent material, with the exception of the marker grid 2*a*, provides an unrestricted view of the characters and graphics displayed.

FIG. 2A shows a preferred arrangement of the lamp housing 100 for fluorescent lamps 4*a*, 4*b* which also functions as a framework for mounting a composite mosaic of the 12 inch blocks or tiles 1 shown in FIG. 1.

In a typical arrangement, the lamps 4*a*, 4*b* may be, for example 8 feet long, and ½ inch in diameter. They are respectively mounted in side-by-side parallel relation between a pair of resilient posts 101*a* and 101*b* (on one side) and 101*c* and 101*d* (on the other side) which carry conventional electrical connections. The mounting posts 101*a*, 101*b* and 101*c*, 101*d* project outwardly from the opposite ends of the rectangular support 102 which is formed of sheet aluminum, say, 0.04 inch thick, bent into a parallel pipe, 3 inches high. 8 inches across the flat top, open at the bottom, and having flanges 103*a*, 103*b*, say ½ inch wide, along opposite lower edges. The latter are screwed, or otherwise fastened, in parallel symmetrical relation to the long axis on the inside surface of the rectangular outer housing 104, the latter is also formed of sheet aluminum 0.04 inch thick, which is bent into hollow rectangular shape, eight feet long, 12 inches across the closed base, with each of the sides five inches high, and terminating along each of the open edges in a pair of inwardly-directed flanges 105*a*, 105*b*, ½ inch wide and extending the length of the housing.

It is contemplated that a plurality of, say, twelve of these housing units 100 are placed side; by side, in contiguous relation, forming a framework, say, fourteen feet long, and eight feet high, for a display sign of that size, the components of which framework, can be welded or bolted together in conventional fashion, as shown in FIG. 2B, and mounted on a vertical wall surface, as convenient for the display sign. It will be understood that a pair of lamps, such as 4*a*, 4*b* in FIG. 2A, will be mounted in each of the housings 100 as installed. The lamps have been omitted to clarify the showing of the assembled structure in FIG. 2B.

Figure 2D:
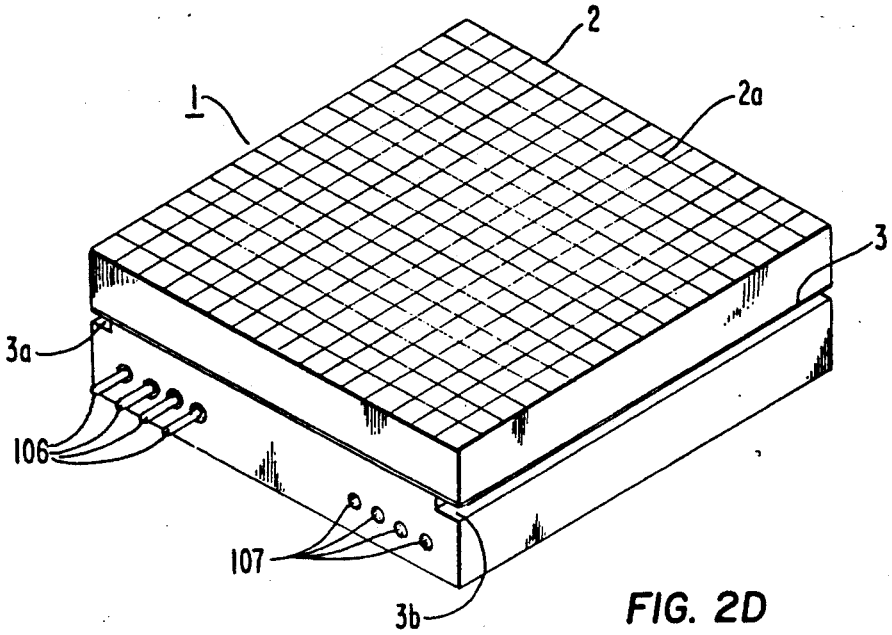
FIG. 2D is a perspective showing of the block of FIG. 1 positioned to be assembled in the mosaic of FIG. 2C.

Referring to FIG. 2B, there is shown, partially broken away, a mosaic formed by a plurality of blocks of the type indicated in FIG. 1 (shown in perspective in FIG. 2D).

Each of the blocks 1 is equipped, on its lateral parallel edges, located just behind the diffusing plate 2, with as pair of rectangular slots 3*a* and 3*b*, each of which is ¾ inch deep and ¼ inch wide. In assembling the sign mosaic, as shown in FIG. 2C, the flanges 105*a* and 105*b* of the lamp-housing supporting framework 100 are slideably accommodated in the slots 5*a*, 5*b* of the respective blocks, which are mounted flush against one another, so that the gold-plated electric male plugs 106 of one block are accommodated in the gold-plated electric female sockets of the next succeeding block. The electric plugs 106 and sockets 107 serve to couple the electric circuits to the driving solenoids 9 and 10 of the movable sign elements, as will be explained hereinafter.

Figure 3A:
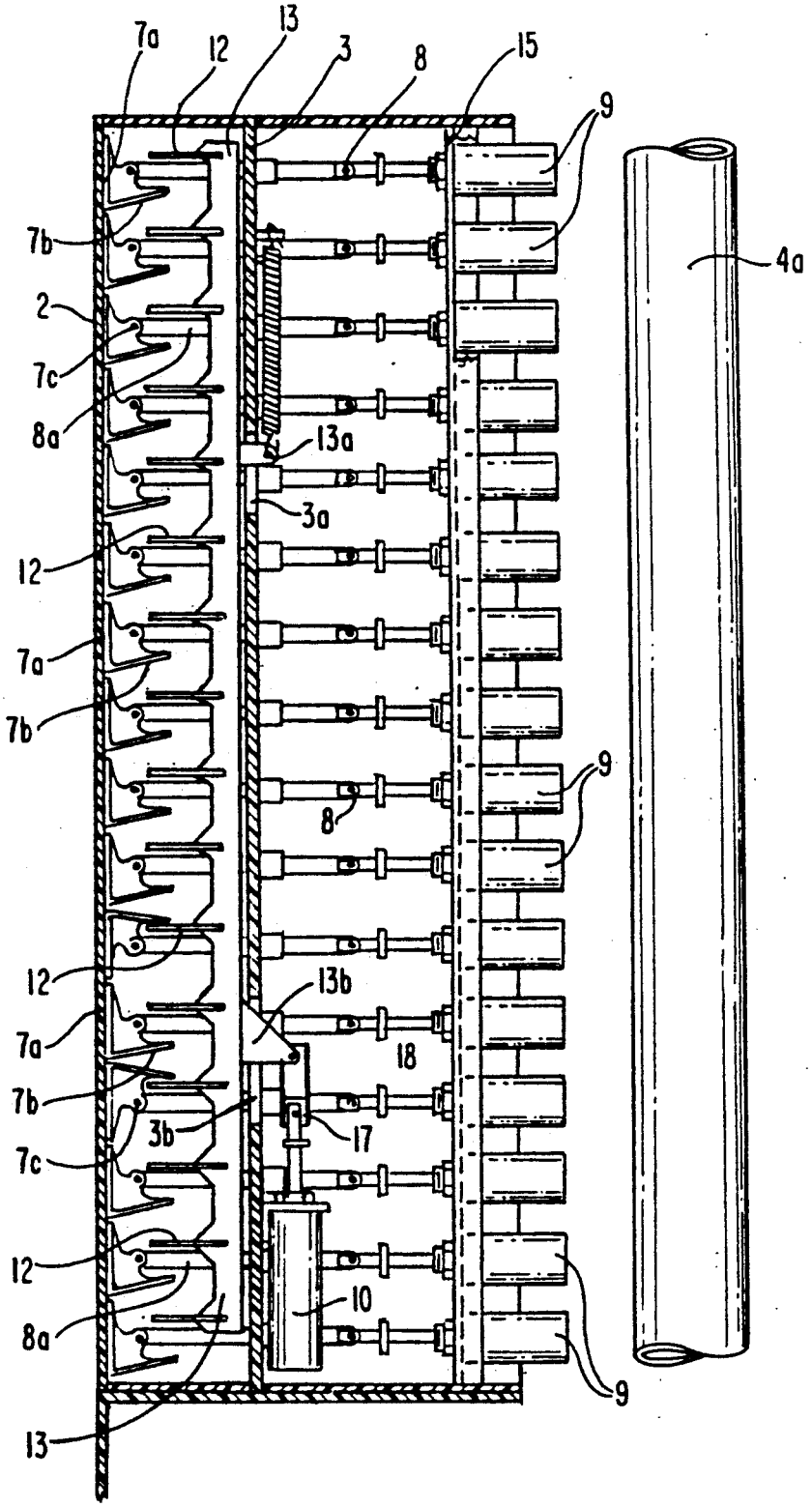
FIG. 3A shows a vertical section of the sign box shown in FIG. 1, viewed along a plane indicated by the arrows 2—2 of FIG. 1.
Figure 3B:
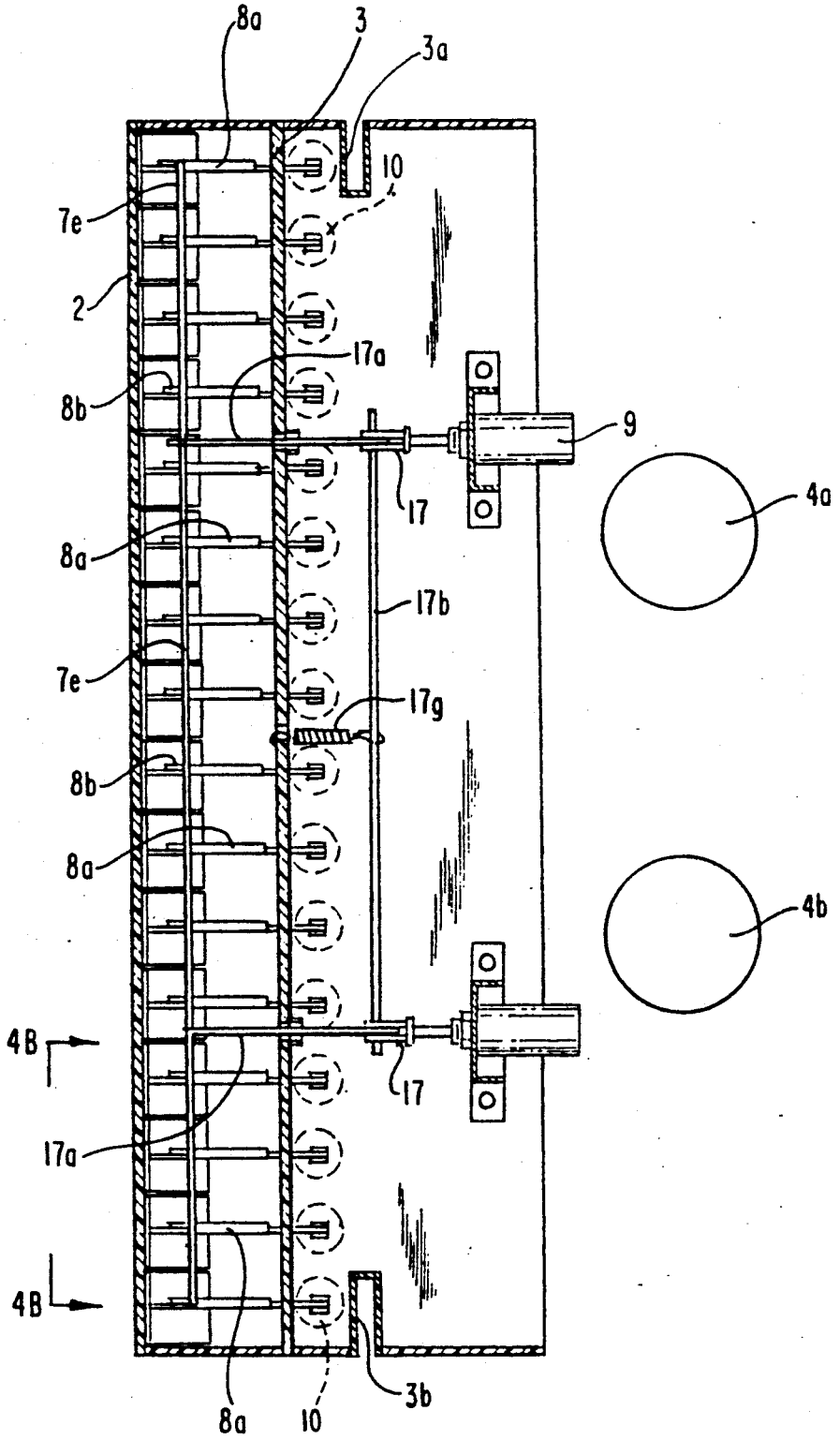
FIG. 3B shows a horizontal section of the sign box of the single block shown in FIG. 1, viewed along a plane indicated by the arrows 3—3.
Figure 4A:
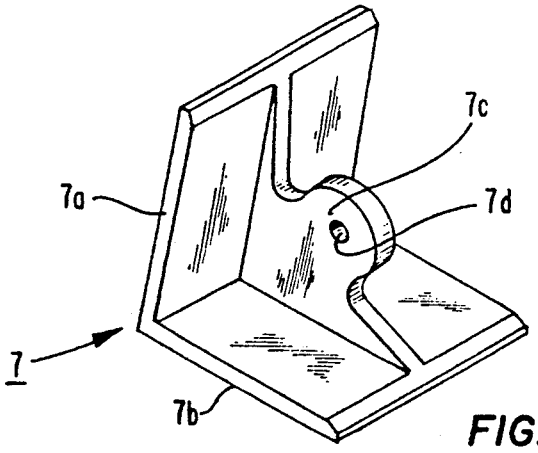
FIG. 4A is a perspective showing of one of the rotatable sign elements 7.

The assemblage of the individual sign elements 1 adjacent the inner surface of display panel 2 as shown in vertical section in FIG. 3A and horizontal section in FIG. 3B, is a rectangular array comprising a composite of basic display units 7 which are each of the individual form indicated in FIG. 4A of the drawings. The display units 7 each comprise a pair of square plates 7*a*, 7*b* of translucent acrylic plastic, ¾ inch on a side and 2 mils thick, which are fastened together along one of their edges at an angle of 80 degrees to form a triangular configuration. Centered between the legs of the triangle and anchored at each of its ends, is a semicircular yoke 7*c* which in each case is supported by parabolic arms extending from the undersurfaces of 7*a* and 7*b*.

In the center of yoke 7*c* is a bearing 7*d* which is mounted for rotation of display unit 7 through a slight angle about a pin 7*e* (see FIG. 3). Pin or rod 7*e* extends through an entire row of display units normal to the axis of the control rods 8*a*. similar pins 7*e* extend through each row of display units 7. The latter rows are mounted to be moved to-and-fro horizontally a distance of ½ inch by the respective solenoids 9. A boss 8*b* adjacent the end of each of the rods 8*a* extends normal to the direction to axis of rod 8 and is disposed to bear against the semicircular surface of the yoke 7*c*. Each of the pins or rods 7*e* is supported by the rods 17 which are held in spaced-apart mechanical relation by the cross-rod 17*b* which is spring biased by the spring 17*c*. The rods 17*a* have to-and-fro motion in a horizontal plane imposed on them by impulses from the solenoids 9 operating through linkages 17, so that they operate to withdraw a selected row of display elements 7 back a distance of ¼ inch from the inner face of the display plate 2.

In its rest position, each of the display units 7 is positioned by the respective rod 8*a* so that one of its plates 7*a* is flush against the inner surface of the display plate 2, conforming to one of the squares of the painted grid 2*a*.

Referring to FIG. 3A, the electromechanical array, including the driving solenoids 9 and their associated linkages 8, and horizontally-extending rods 8*a*, are mounted in a frame in equally spaced-apart parallel relation on a rigid vertically-extending rack 15, which is parallel to and located 1 inch to the rear of the diffusion plate 3. Each of the rods 8*a*, which is formed of transparent plastic material, passes through and is supported in an opening in the diffusion plate 3, wherein it is journalled to move ½ inch to and fro horizontally.

A vertically movable comb-like rack 13 of transparent acrylic plastic, is supported to move up and down a distance of ¼ inch against the forward face of the diffusion plate 3. The rack 13 has sixteen comb-like transparent teeth 12, which project ¾ inch in a forward direction, and are spaced apart ¾ inch in a vertical direction. The rack 13 is supported by the projecting members 13*a* and 13*b* which respectively ride in the slots 3*a* and 3*b* in the diffusion plate 3. Slot 3*a* is ½ inch long; and slot 3*b* is 1 inch long.

The rack 13 is spring-biased for motion in a vertical direction by the coil spring 16 which is connected between the fixed projection 16*a* from the inner face of diffusion plate 3, and the movable projection 13*a* connected to the rear of the comb-like structure 13, and which moves in the slot 3*a*. The rack 13 is driven to move up and down in slots 3*a*, 3*b* by electronic signals which operate the solenoid 10 through the mechanical linkage 18.

Figure 4B:
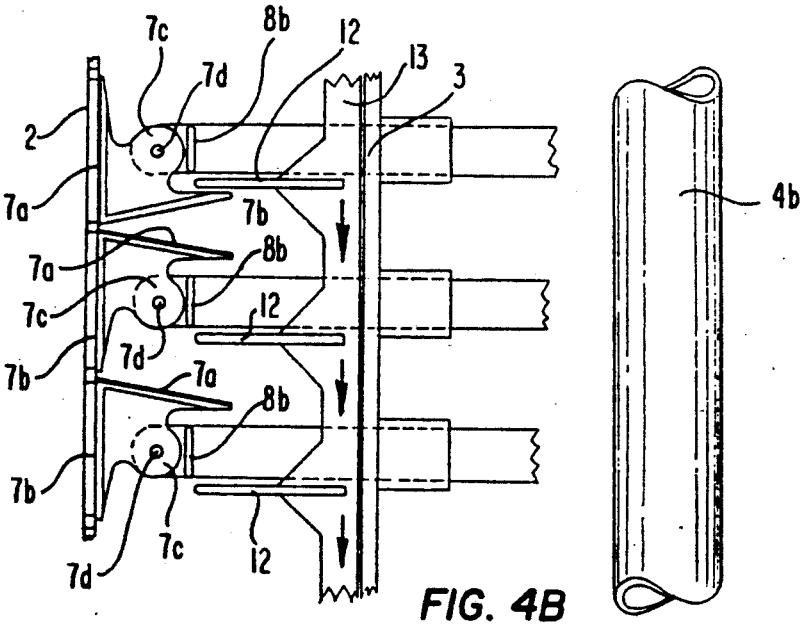
FIGS. 4B and 4C show an enlarged fragment of the portion indicated by the arrows 4B—4B of FIG. 3, with the rotatable elements in to different positions, as will be described hereinafter.

FIG. 4B is an enlarged fragmentary view of a section of FIG. 2, including the comb-like rack 13 and the rods 8*a*. The rack 13 has been moved down a small distance in the direction indicated by the arrows by operation of the solenoids 10. In the upper one of the three units shown, the teeth 12 project forward in contact with the under side of the yoke 7*c* of display face 7*b*. The display face 7*a* is flush against the front display plate 2. In the lower two units, the teeth 12 are out of contact with the yoke 7*c* of display face 7; and the face 7*b* is flush against front display plate 2.

Figure 4C:
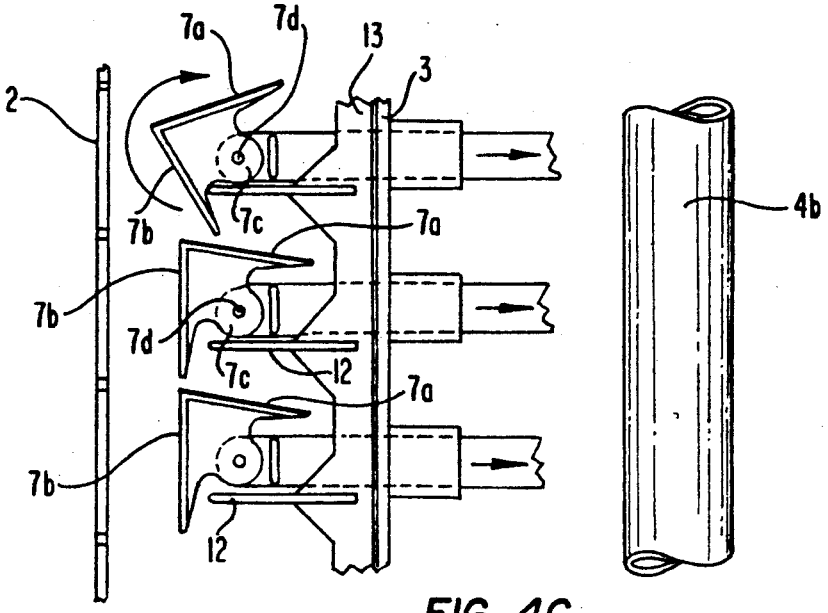

FIG. 4C shows the same section as FIG. 4B, in a second position. The comb 13 remains down. Display units 7 as shown in FIG. 4B have been retracted in a horizontal direction indicated by the arrows, by operation of the solenoids 9. This causes the upper one of the display units 7 in contact with one of the teeth 12 to rotate bringing face 7*b* parallel to display plate 2. The lower two units remain in their same positions.

Figure 5:
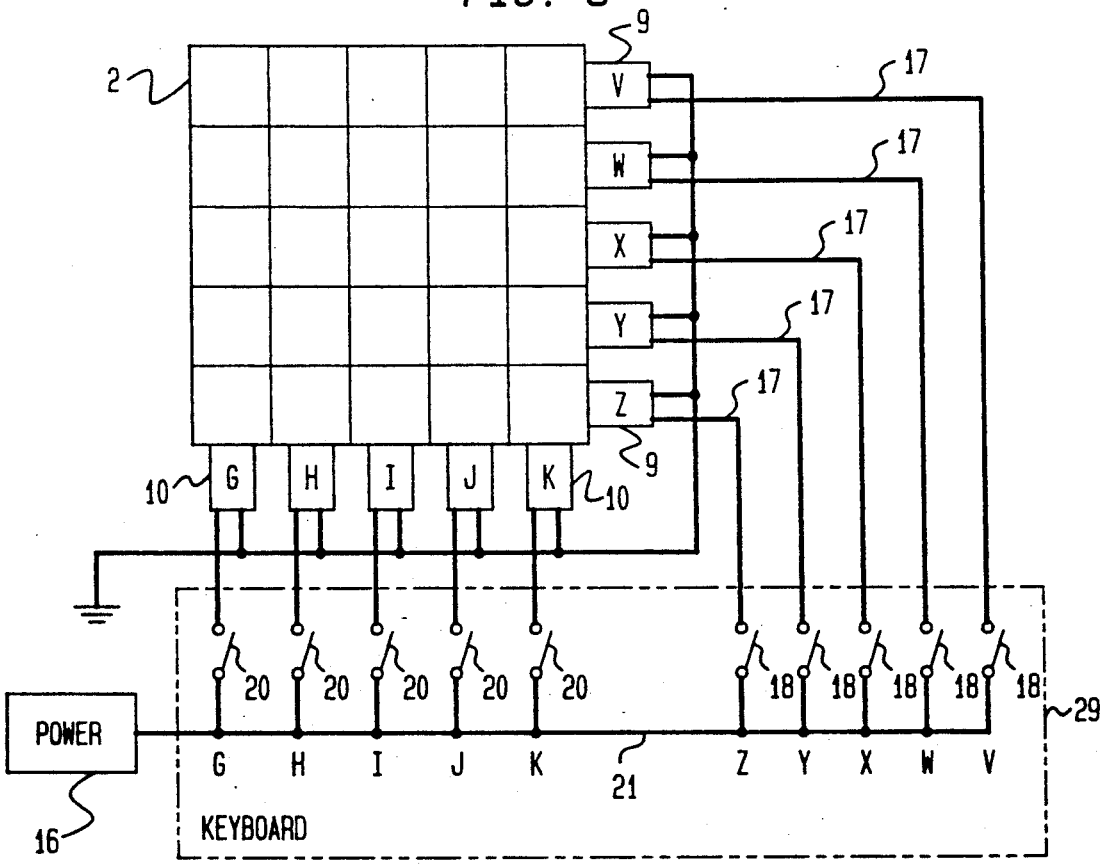
FIG. 5 shows a circuit schematic for driving the electromechanical system for controlling the sign graphics by keyboard in the back-lighted sign of the present invention.
Figure 6:
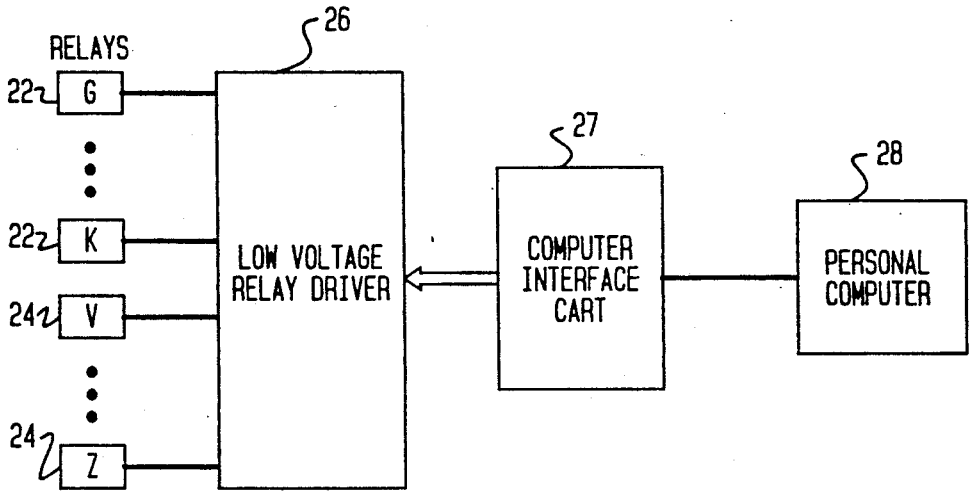
FIG. 6 shows the schematic diagram of a computerized control circuit for driving the solenoids for implementing the graphics of the back-lighted sign of FIG. 1.

The characters and graphics displayed by the sign 1 can be controlled either from a conventional keyboard 29, as shown in FIG. 5, or from a system driven from a personal computer 28, as shown in FIG. 6. For convenience of describing the operation of the device, a small block of 25 display elements has been chosen at the center of the sign. (See FIG. 1.) These are designated by vertical rows G, H, I, J, K, and horizontal rows V, W, X, Y, Z.

FIG. 5 shows the central portion of a sign in accordance with FIG. 1 of the present invention in which a series of single-pole keyboard switches 20 (G, H, I, J and K) connect a conventional source of power 16, through switches 20, which may, for example, be 24 volts D.C., to energize a matching series of solenoids 10, each directed to drive the combs 13 on a vertical column of the sign array. Likewise, a series of single-pole keyboard switches 58 (Z, Y, X, W and V) connect the source of power 16 to energize a matching series of solenoids 9, each directed to a horizontal row of display units 7 of the sign array.

Alternatively, a personal computer 28 of any of the types well known in the art, can be adapted to operate through a computer interface card 27 of a type well known in the art which is connected to a low-voltage relay driver 26, the output of which drives a series of relays 22 and 24 to perform the functions performed by the solenoids 10 and 9 of FIG. 5, by methods of operation well known in the electronic arts.

FIG. 7 is what is known in the trade as a "truth chart" which plots position on the screen against time of operation for both the horizontal row solenoids 9 and the vertical combination solenoids 10, corresponding to the configuration which is enlarged to appear on the face of the display screen 2, as shown, for example, in FIG. 1. A truth chart is prepared which is unique to each desired sign display.

Assuming the display is in the form of that shown in FIG. 1 of the drawings, the X marks on the turntable, FIG. 7, indicate the time cycle for empowering the solenoids 9 and 10, for setting up the display on the screen 2.

Figure 8A:
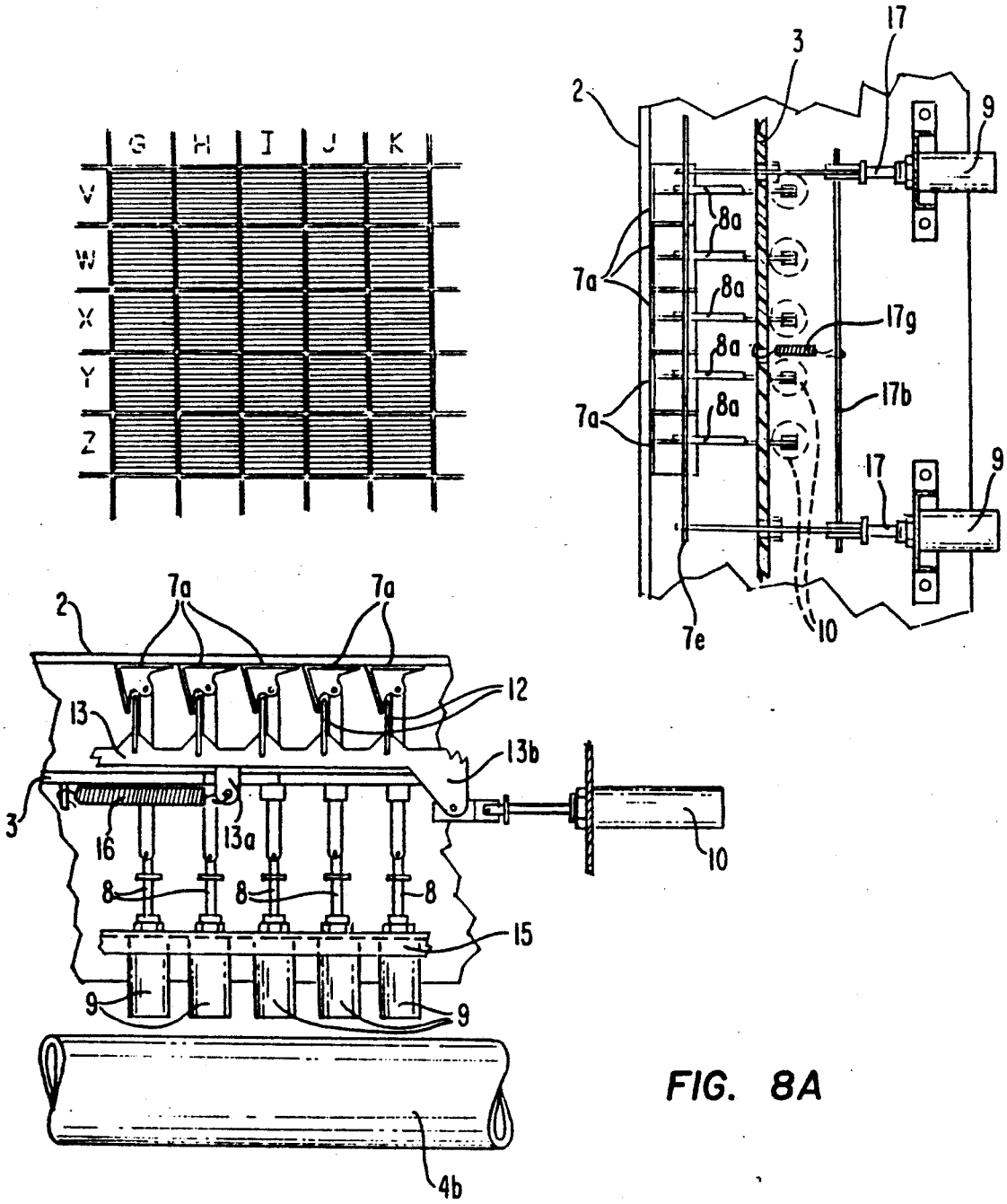
FIGS. 8A, 8B and 8C, show schematically, operational steps for implementing the graphics of the back-lighted sign of FIG. 1.
Figure 8B:
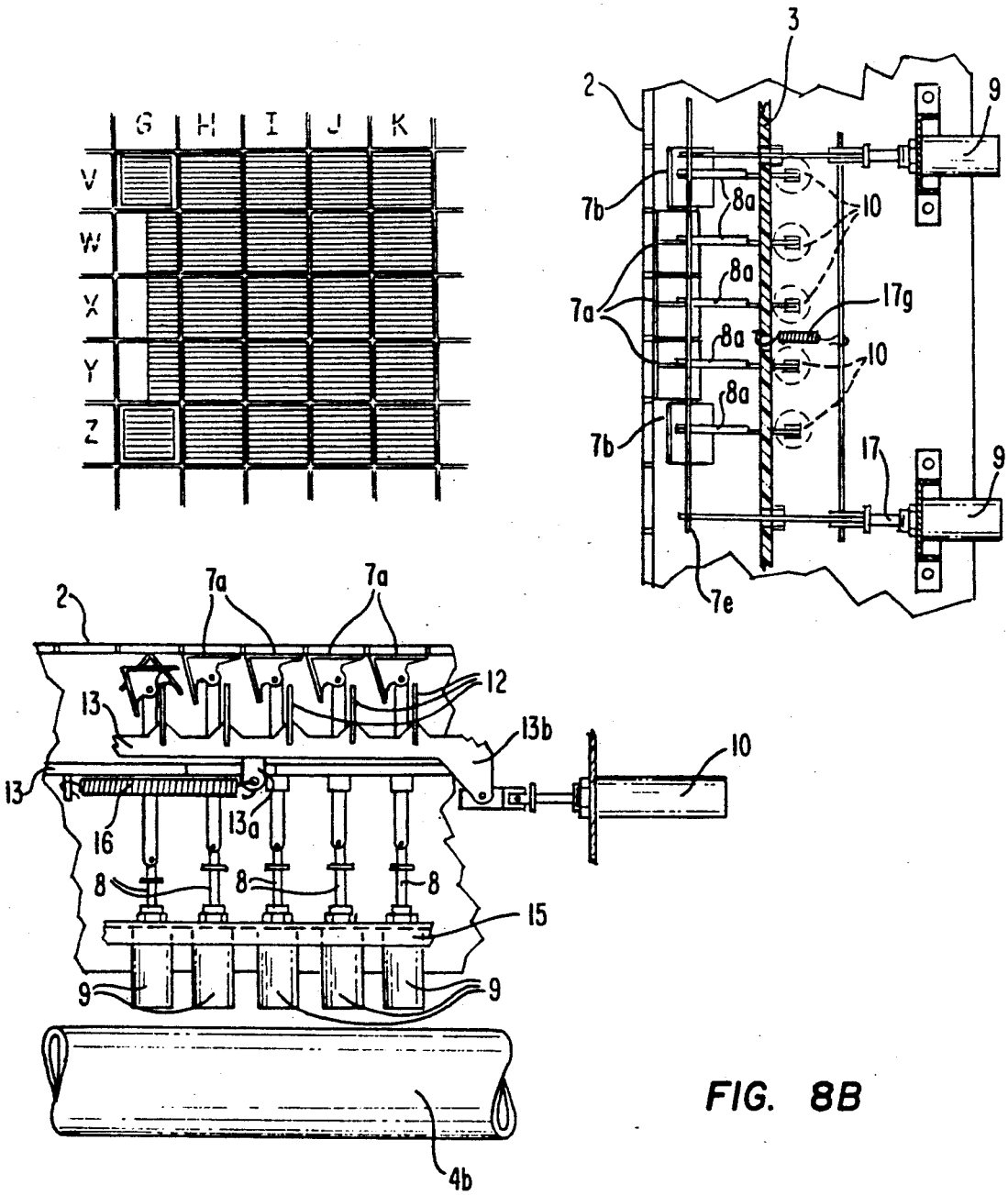

Examples indicating the operational steps of the sign configuration of FIG. 1 are shown in FIGS. 8A and 8B.

For simplicity in explaining the operation, the pattern indicated on the display plate 2 in FIG. 1 and in the truth chart of FIG. 7 has been restricted to the central portion of the screen, involving only columns G, H, I, J and K, and rows V, W, X, Y and Z. It will be apparent that the same principles of operation will apply to a larger pattern extended to the edges of the screen, or to a larger screen.

The first step is shown in FIG. 8A, which conforms to the first second of the time cycle as shown by the truth table, for the specific configuration as illustrated in FIG. 1 which it is desired to put on the display face 2 of the sign.

The solenoids 10 corresponding to vertical columns V and Z in our illustrative pattern are energized pulling back the comb-like racks 13 in each of those two columns so that in each, the projection 13*a* on the relevant comb-like rack 13 moves down a distance of ¼ inch in its slot in diffusion screen 3. This causes each of the teeth 12 in the selected columns V and Z to move down a corresponding vertical distance with reference to a corresponding one of the display elements 7. Each of the comb-like elements 13 is spring biased by the coil-spring 16 to which it is attached.

During the second step, shown in FIG. 8B, the elected solenoids 10 remain energized, holding the elected comb-like racks 13 in pulled-back relation in the vertical columns V and Z.

Simultaneously, in the second step, solenoids 9 in horizontal row G are energized actuating the linkages 17, 17*a* and 17*b* to pull back the rod 7*d* a horizontal distance of ½ inches behind the front display plate 2. This causes those display elements 7 in row G, which are also in the pulled down columns V and Z, to contact the adjacent teeth 12, and spin about the rod 7*e*, whereby they present their dark faces 7*b* parallel to the plane of display plate 2.

Figure 8C:
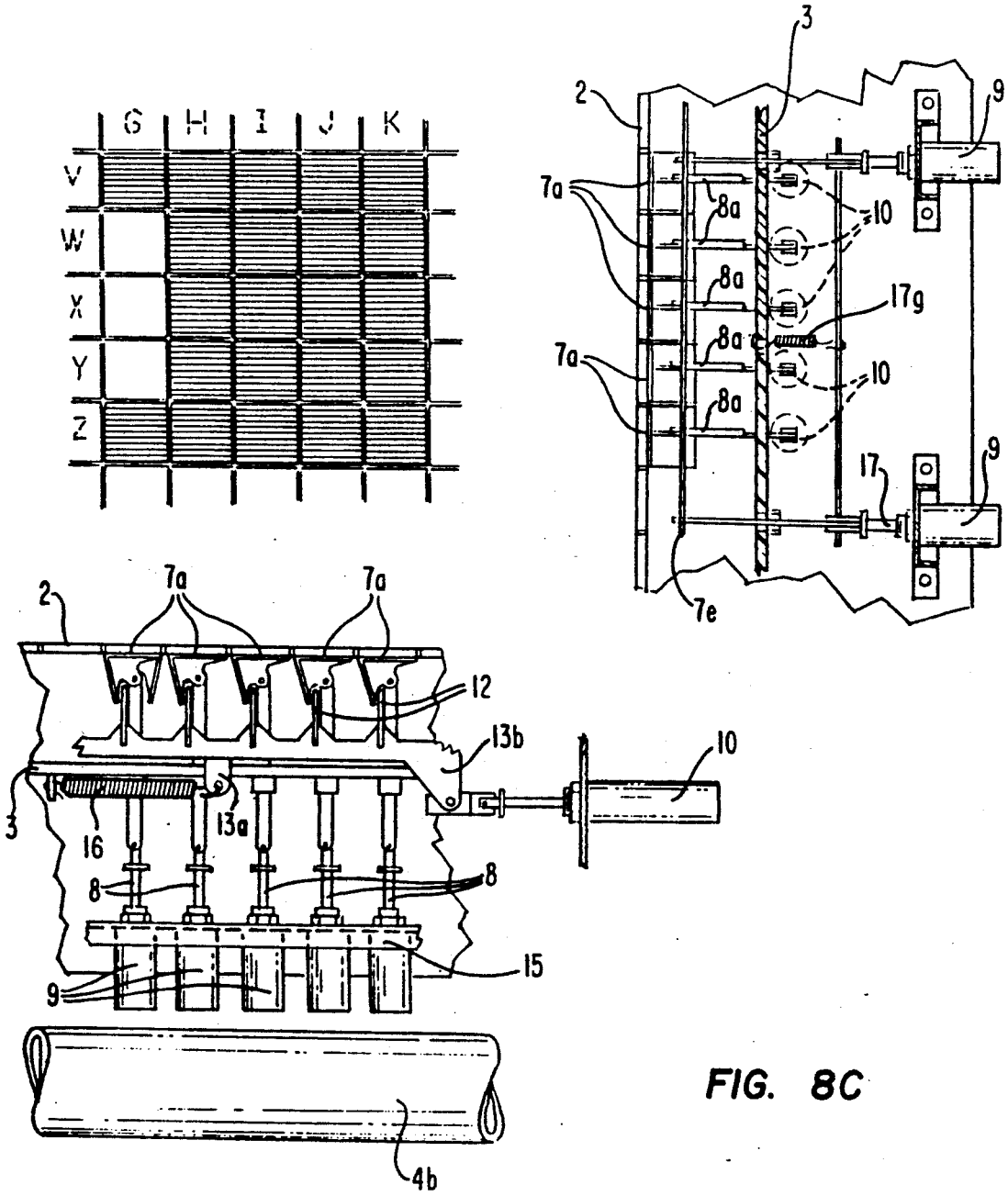

During the third step, shown in FIG. 8C, the power to the solenoids 10 for columns V and Z is released. This causes the comb-like racks 13 in columns V and Z to return to their original or rest positions by operation of the biasing springs 16. Simultaneously, the power to solenoids 9 in row G is released, causing the display elements in row G to move forward adjacent the inner face of display plate 2 in response to the bias of spring 17*g*. Thus, during the third second in the time line, as indicated on the truth chart shown in FIG. 7, all power is released, and the configuration shown on the screen will be as shown in FIG. 8C of the drawings.

It will be apparent that the same three steps as related by the truth table shown in FIG. 7 will be repeated to place the remaining portions of a desired configuration on the screen, as shown in the unique configuration of FIG. 1.

For example, beginning with the fourth second in the time cycle, the solenoids 10 are energized to activate the comb-like racks in columns W and Y to move downward.

During the fifth second, the power is retained in solenoids 10 to the comb-like racks in columns W and Y. During the fifth second, the solenoids 9 for horizontal row H are energized, pulling back the display elements 7 in row H. The display elements 7 in columns W and Y, row H are spun to their 7*b* positions by contact with the comb teeth 12 in columns W and Y.

During the sixth second in the time cycle, the power is released, and the dark configuration 7*b* in row H, columns W and Y appear against display plate 2, together with the configuration imposed in the first three seconds of the time cycle.

This process is repeated (thru 14 seconds in the present example) until the entire configuration desired is imposed adjacent the display screen 2.

It will be apparent that the presence of the diffusion screen 3 between the fluorescent light sources 4*a*, 4*b* and the display screen 2 prevents the presence of shadows produced by the electromechanical operating mechanism from appearing on the display screen 2 in such a manner as to interfere with or obfuscate the letters, numerals or other graphics constituting the screen display.

Figure 9A:
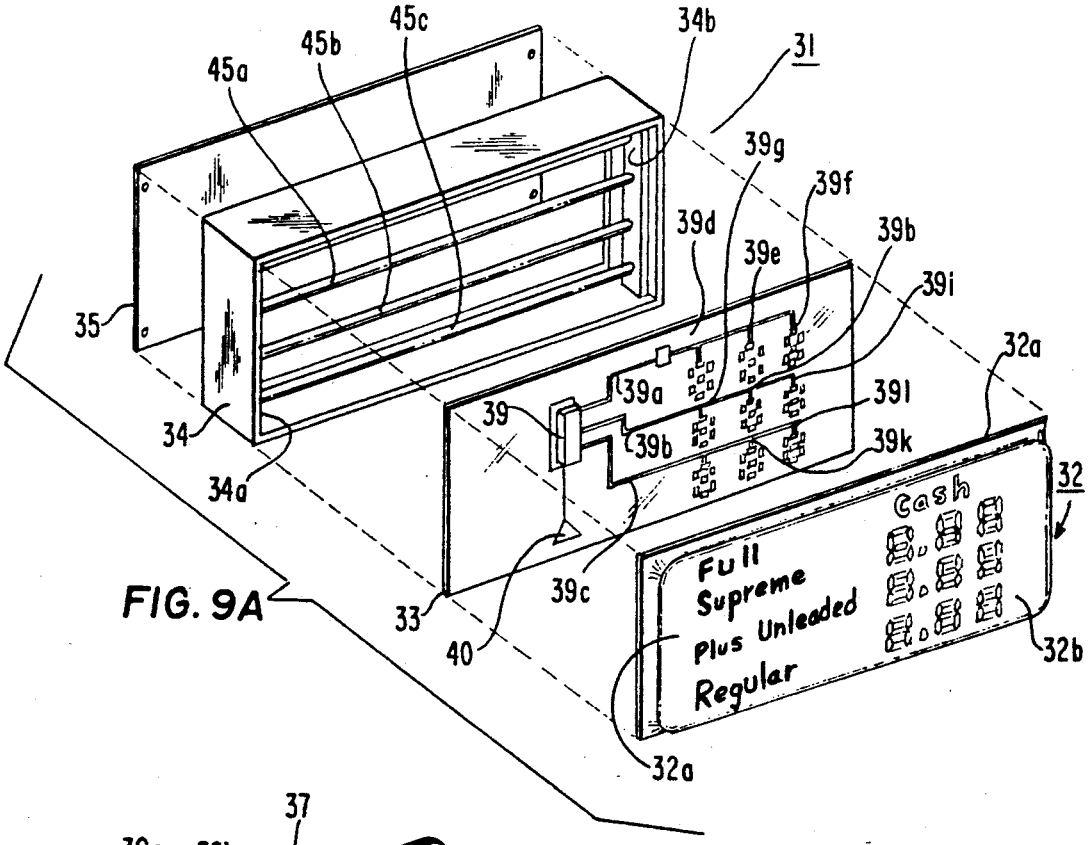
FIGS. 9A, 9B and 9C show, in perspective, an alternative form of the back-lighted sign of the present invention.
Figure 9B:
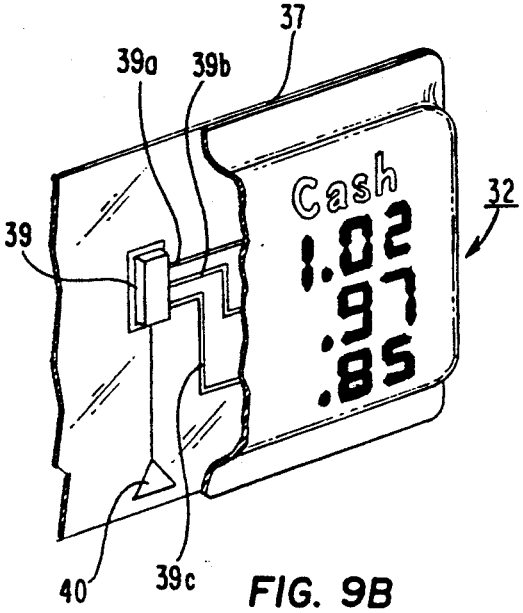
Figure 9C:
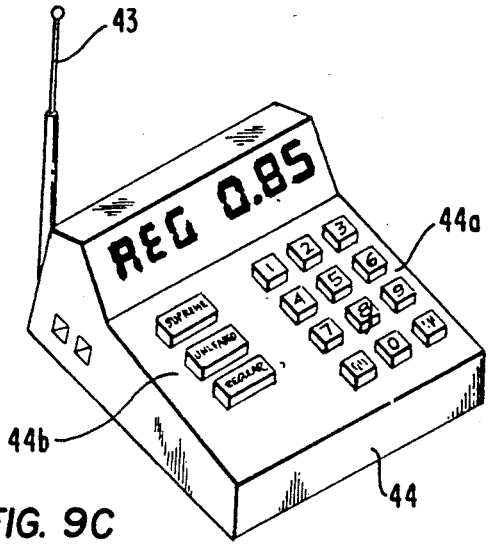

It will also be apparent that the principle of the invention can be applied to a back-lightable sign structure such as shown in FIGS. 9A, 9B and 9C having a substantially different structure and type of operation.

The sign structure shown in FIGS. 9A, 9B and 9C, and in part, in FIGS. 10, 11, 12A, 12B and 12C, is adapted to be used for displaying the prices at fuel pumps, and in similar devices, where it is necessary to change the prices indicated from time to time, from a remote position, such as a keyboard, or telephone transmitter of types which are well known in the art.

FIG. 9A shows the elements of the sign box in exploded relation. The front display plate 32 is, for example, an oblong plate 32, of rigid plastic material, such as, for example, a plate of an acrylic or polycarbonate resin, ¼ inch thick, which is, say, five feet long and two feet high.

On the right-hand portion 32*a* of display plate 32 is permanently inscribed say, in black letters against a translucent white background with legends which, in the present example, relate t the sale of different types of gasoline. Aligned with each of these, on the left-hand portion 32*b* of display panel 32 under the word "cash", are three rows, each of three clear transparent shapes of what are known in the trade as the "seven segment display". These give the appearance of stylized figure eights, each formed of seven hexagonal segments fitted together, which in the present case, are 8 inches in overall length and 4 inches wide. By blocking out or filling in each of the seven segments of the stylized figure eight, a shown, each of the digits, 0 through 9, can be formed so that any numerical combination can be shown on the sign. A decimal point is interposed between the first right-hand figure in each row, and the next two figures to distinguish between dollars and cents.

The plate 32 has a flanged edge 32*c* which is designed to enable the top plate 32 to fasten over and close the front of the sign box 34. In the present example, the latter is, say, three feet long, two feet high, and one foot deep, and formed of rigid opaque plastic, such as, for example, high density polyethylene or similar material. The rear is closed by an opaque plate 35 of similar material.

Mounted across the interior of compartment 34, part way between the front and rear panels, on a vertical plane 8 inches from rear panel 35, is a bracket 34*b* on which are mounted three conventional fluorescent light sources 45*a*, 45*b* and 45*c*, equally spaced apart in longitudinal parallel relation. The bottom light source 45*c* is spaced a vertical distance of 6 inches above the bottom inner surface of compartment 34. Light sources 45*c*, 45*b* and 45*a* have their centers spaced apart 12 inches in a vertical plane; and light source 45*a* is spaced with its center 6 inches below the upper inner surface of compartment 34.

Interposed between the vertical plane on which light sources 45*a*, 45*b* and 45*c* are mounted and the front display plate 32, when the same is in place across the front surface of compartment 34, is the diffusion plate 33, which in the present embodiment is approximately 5 feet long and 2 feet high, and, say ¼ inch thick.

The diffusion plate 33, in the present embodiment may assume any of the forms described with reference to diffusion plate 3 in the embodiment of FIGS. 1 et seq. For example, it may be formed of a rigid plastic material, such as an acrylic plastic in which has been interposed a dispersion of white particles. The plate 33, is preferably a stock flat ¼ inch acrylic white plastic sheet.

The vertically-disposed plate 33 snaps into place against the edges of a pair of flanges 34*a* and 34*b* of the frame which supports light sources 45*a*, 45*b* and 45*c* in the compartment 34, so that the inner surface of plate 33 is spaced apart a horizontal distance of 4 inches from the central vertical plane on which the light sources 45*a*, 45*b* and 45*c* are mounted; and the outer surface of plate 33 is spaced apart a horizontal distance of 5 inches from the inner surface of the display plate 32.

On the front surface of the plate 33 is mounted a conventional radio receiver 39 which is of the general circuit arrangement of the pocket pages manufactured and sold by Motorola Inc. code-names #ADSJRB5661 BARR6BPQ2WS6, Radio Frequency, operating at 931,1625 MegaHerz, Underwriters Laboratories listed 830H.

For the purposes of the present invention, the display element in the circuit identified above is replaced with a low-voltage relay driver. The relay driver operates to latch the appropriate relays to each element of the paging address to the display circuits. In turn, the selected relay is constructed to drive the motor of the corresponding one of each of the seven mechanisms 39*d*, 39*e*, 39*f*, 39*g*, 39*h*, 39*i*, 39*j*, 39*k*, 39*l* which comprise each of the seven segment displays. A light switch in each of the seven mechanisms will stop the motor at the appropriate terminal point.

The three output terminals 39*a*, 39*b*, and 39*c* from a conventional computerized receiver 39 are connected through three corresponding conductors of, for example, silver or copper wire, which each extend 22 inches, in parallel locations spaced apart in a vertical plane by the insulation between them. In the present examples, each of the wires 39*a*, 39*b*, and 39*c* ends in a plurality of terminals 38 which are mechanically coupled to change the position in one of a pair of hexagonal display elements, to alternatively substitute a dark face for a white face in one of the seven segments of FIG. 10, thereby converting the display into a preselected digit in a manner well known in the art as the "seven segment" display system.

Figure 10:
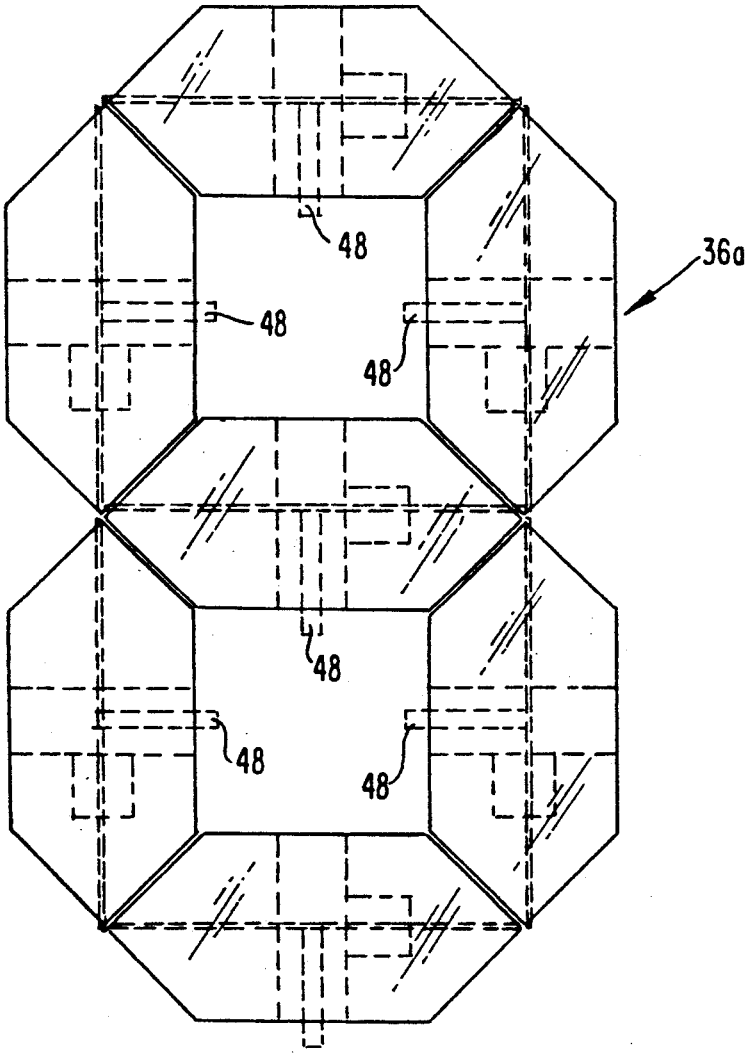
FIG. 10 shows, in life size, a transparent figure-8, appearing on the viewing face of the back-lighted sign of FIGS. 9A, 9B and 9C.
Figure 11:
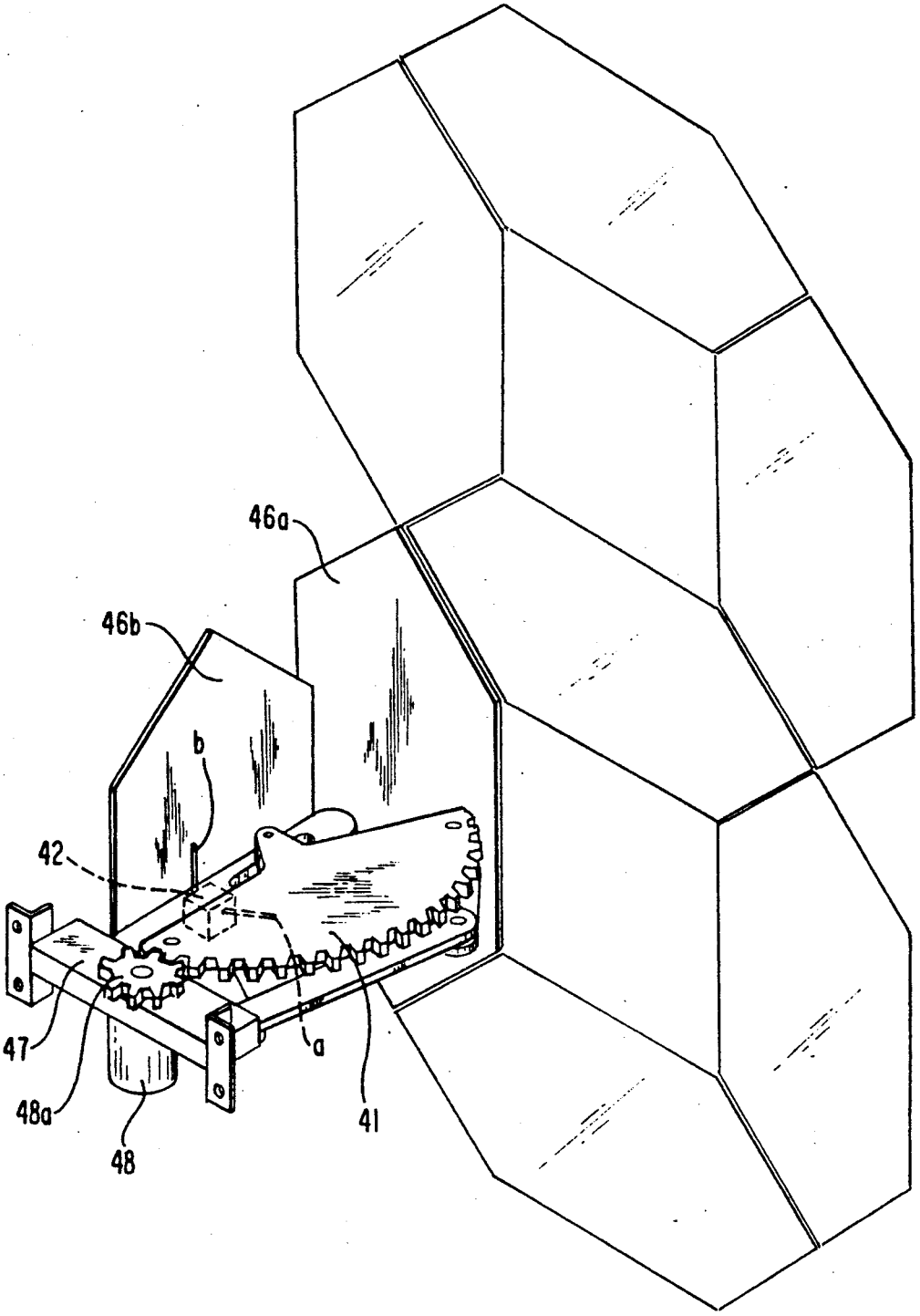
FIG. 11 shows one of the blocking sign elements of FIG. 9 mounted for rotation adjacent a transparency in the viewing face of FIG. 10.
Figure 12A:
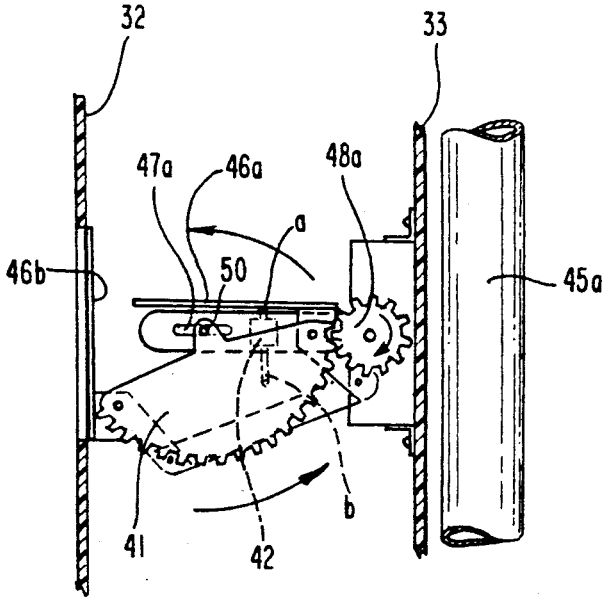
FIGS. 12A, 12B and 12C, show operation of the driving means of the blocking elements of FIG. 9.
Figure 12B:
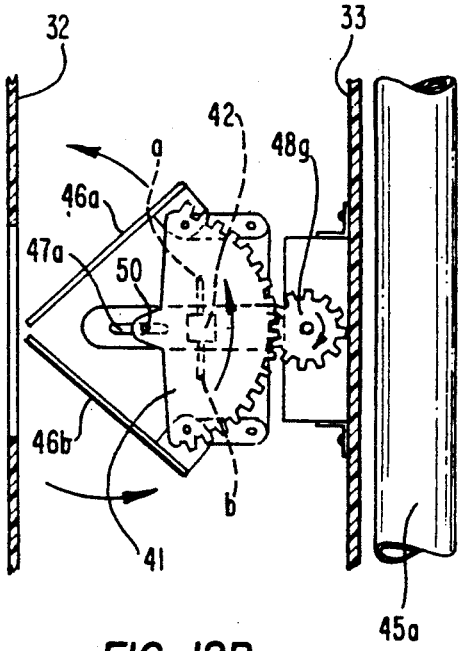
Figure 12C:
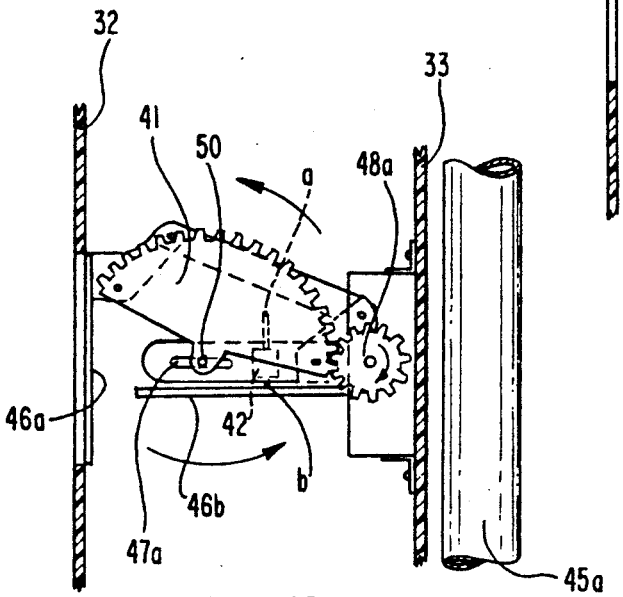

FIG. 10 is an actual sized illustration of a single one of the transparent figure-eight configurations which appears on the face of display plate 32. Looking through FIG. 10 one sees each of the seven pairs of dark and light-faced hexagonal display elements, each pair being mounted for rotation about an axle 48 by means of a worm gear mechanism, as shown in FIGS. 11 and 12*a*, 12*b*, and 12*c*, thereby alternatively presenting its dark or light face forward. Thus, the transparent figure eight is converted into a selected one of the ten digits in a manner well known in the art, depending on which ones of its seven segments has dark or light display elements rotated into place. A similar routine is followed in connection with each of the transparent figure-eight configurations of section 32*b* of the display plate 32, segments of which are blocked off by selective rotation of the elements in 39*d*, 39*e*, 39*f*, and 39*g*, 39*h*, 39*i* and 39*j*, 39*k*, 39*l*.

A remote control transmitter 44 may be of any of the types well known in the art. For example, the circuit may be substantially similar to that of a Motorola local area paging transmitter which has been modified by adding to the conventional numeric keys 44*a*. Three extra keys 44*b* of which are constructed to generate distinct characters in addition to the pulses generated by the numeric keys. The added keys 44*b* will allow transmitter circuit 44 to send out an aerial ASCI code of AS, B, or C before the transmitted ASCI number to permit the receiver 39 to distinguish which of the three rows is to be changed to correspond to a transmitted number. Transmitter 44 is designed to transmit a series of pulsed originals, in accordance with the numbers depressed on the conventional keyboard 44*a*, through the antenna 43 and the computerized receiver 39 which will generate the pulses to drive selected ones of the display elements in 39*d*, 39*e*, 39*f*, 39*g*, 39*h*, 39*i*, and 39*j*, 39*k*, 39*l* to rotate into position to change the appropriate cash indication on the display face 32 as desired.

Referring to FIGS. 11 and 12A, 12B and 12C, there is shown the operation of a single segment in which the motor 48 is driven to rotate, by means of a selected signal. The mechanism for selectively changing digits on section 32*b* of display plate 32 is better understood by a study of the foregoing figures and description which show one type of mechanism for carrying out this operation.

The motor 48 responds to a selected pulsed code from the computerized receiver 39, to rotate its shaft clockwise or counterclockwise, as the case may be. This rotates a spur gear 48*a*, which rides on a semi-eliptical gear 41 mounted at its center to rotate about a pin 51 which is slideably mounted to move in linear slot 47*a*, which is on a line bisecting gear 41. Semi-eliptical gear 41 diametrically opposite points, each of the pins being rotated in a bearing fixed to the opposite edge of the under face of one of the two light and dark-faced display elements 46*a*, 46*b*. The two light and dark display elements are coupled together at the corners on one under side of a frame in the form of a parallelogram, the other two corners of which are rotatably coupled at angles which vary from acute to obtuse. This arrangement enables one of the display elements 46*a*, to have its outer surface parallel to and in substantially flush relation against a relevant segment of the transparent figure 8, while the other display element 46*b* is moved behind in a plane substantially normal to the first display element 46*a*. Rotation of the shaft of motor 48 interchanges the positions of the two display elements, with the one display element 46*a* sliding behind the second display element 46*b* which is then interposed substantially flush against the transparent segment, with the first display element 46*a* assuming a position to the rear of and normal to the second display element 46*b*.

Limit switches 42*a* and *b* are interposed near the inner end of the slotted bar 47. In the position of gear 41 shown in FIG. 12A, limit switch b is opened; limit switch a is closed. When the gear 41 moves to the position shown in FIG. 12B, if going to the a position, the a wire release is set; if going to the b position, the b wire is set. This prevents both relays from being on simultaneously. When the gear 41 is in position shown in FIG. 12C, limit switch 42*a* is open and 42*b* is closed.

Because of the diffusing character of the plate 33 which is interposed between the light source(s) 45*a*, 45*b* and 45*c* and the display plate 32, shadows of the electromechanical control elements are substantially eliminated from the display plate 32, which displays only the alphanumerical symbols and graphics intended.

It will be understood that the present invention is not limited to the specific examples shown by way of illustration, but only in the recitations of the appended claims.

What we claim is:

1. A back-lightable sign which comprises in combination;

a source of light, a display panel in the path of light from said source, said display panel for displaying alphanumeric characters and graphics comprising a plurality of mechanically movable display elements which move interchangeably from a first position in which a dark face is visible to a second position in which a bright face is visible;

means for manipulating said mechanically movable display elements from said first position to said second position and vice versa;

and diffusion means interposed between said source of light and said display panel for scattering the light falling on said display panel from said source whereby shadows cast by said means for manipulating said mechanically moving display elements are substantially invisible from the front of said display panel;

in which said diffusion means comprises a plate of solid translucent material interposed between said source of light and said display panel, said plate constructed and arranged to diffuse light passing through said plate;

wherein said mechanically-moveable elements are arranged in rows and columns corresponding to the width and length of said display panel, wherein each of said mechanically movable elements comprises a first rectangular plate having a dark surface, and a substantially identical second rectangular plate having a bright surface, said first plate and said second plate being fastened together along one of each of their edges to form a triangular configuration in which the dark plate faces outward on one side and the bright plate faces outward on the other side, a yoke connected between the undersides of said plates in each of said elements, said yoke having bearings at opposite ends.

a pin interposed through said bearings in each row of said elements for rotating said mechanically movable element with said pin as an axis from a first position in which said dark face is in substantially parallel flush relation with the inner surface of said display panel to a second position in which said bright face is in substantially flush relation with the inner surface of said display panel, and vice versa;

means for retracting each of said pins and each of said rows of mechanically movable elements under spring bias in a direction away from the inner surface of said display panel for conditioning a row of said movable elements for rotation from one said position to another said position;

means comprising a comb having a plurality of teeth extended in the direction of said movable elements, which comb extends in a length direction of said display panel transverse to said pins, said comb constructed to be moved down under spring bias whereby said teeth contact said movable elements conditioned to rotate;

driving means for conditioning said mechanically movable elements to rotate from one said position to another said position, and driving means for driving a selected comb to move downward, whereby the teeth of said comb contact a conditional mechanically movable element in response to a code of preselected signals to move said movable elements to form a sign in accordance with said signals.

2. A back-lightable sign in accordance with claim 9, wherein said diffusion means comprises a medium including a suspension of comminuted particles.

3. A back-lightable sign in accordance with claim 9 in which said diffusion means comprises a plate of solid translucent material interposed between said source of light and said display panel, said plate constructed and arranged to diffuse light passing through said plate.

4. A back-lightable sign in accordance with claim 3 wherein said plate is selected from a group consisting essentially of: mat glass, semi-rigid or rigid plastic material having a roughened surface, mat glass or semi-rigid or rigid plastic material having an etched or frosted surface, configured glass or plastic having a hammered design, roughened glass or plastic material including a prismatic design, or glass or plastic material including a suspension of comminuted particles.

5. A back-lightable sign in accordance with claim 3 in which said plate of solid translucent material consists essentially of a thermoplastic material.

6. A back-lightable sign in accordance with claim 5, wherein said plate consists essentially of thermoplastic material derived from an acrylic resin.

7. A back-lightable sign in accordance with claim 3, wherein said plate of solid translucent material is constructed to pass through the thickness thereof at least about fifty percent (50%) of the light incident on one side of said plate.

8. A back-lightable sign in accordance with claim 1, wherein said mechanically movable display elements comprise a system of alphanumeric characters;

and said means for manipulating said mechanically movable display elements comprises remote control means.

9. A back-lightable sign in accordance with claim 8, wherein said remote control means comprises a keyboard having a system of alphanumeric characters corresponding to the characters represented by said display elements which are constructed to be manipulated to change the position of said display elements in accordance with a preselected display program.

10. A back-lightable sign in accordance with claim 8, wherein said remote control means comprises a computer and means for programming said computer to change said display elements in accordance with a preselected computer program.

11. A back-lightable sign in accordance with claim 1, wherein said alphanumeric display is what is known in the art as the "seven segment" numerical display.

12. A back-lightable sign in accordance with claim 11, wherein said "seven segment" numeric display comprises a transparent figure eight comprising seven transparent octagonal segments;

a dual element comprising a dark and a light octagonal display element rotatably mounted for alternative display in flush relation in each segment of said transparent figure eight;

a motor and gearing means for driving each said dual display element to rotate from showing said dark to showing said light octagonal display element in flush relation with one of the segments of said seven segment display, and visa versa; and remote control means for driving said motors in accordance with a preselected program.

13. The combination in accordance with claim 12, wherein said remote control means is a keyboard having alphanumeric keys corresponding to digits 0–9.

14. The combination in accordance with claim 12, wherein said remote control means is a computer in energy transfer relation with said motor; and means for programming said computer in accordance with a preselected program to change the alphanumeric display on said sign.

15. A back-lightable sign in accordance with claim 1, wherein said sign comprises a plurality of substantially identical rectangular blocks; and said source of light comprises at least one elongated cylindrical light bulb;

an elongated rectangular housing enclosing said light source in position to direct the light from said source through said rectangular blocks;

said housing including a frame work for assembling the sign blocks of said plurality into an interlocking coplanor mosaic.

16. A back-lightable sign in accordance with claim 15 wherein said frame for assembling the blocks of said plurality into a coplanor interlocking mosaic comprises a pair of parallel flanges directed inwardly from the longitudinal edges of said housing;

and wherein each of said blocks includes on its outer lateral edges a pair of parallel slots constructed to slideably accommodate the flanges of said elongated rectangular housing.

* * * * *